US007378787B2

(12) United States Patent
Lee et al.

(10) Patent No.: US 7,378,787 B2
(45) Date of Patent: May 27, 2008

(54) FLAT PANEL DISPLAY DEVICE

(75) Inventors: Soo-Joung Lee, Suwon-si (KR); Su-Kyung Lee, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 547 days.

(21) Appl. No.: 11/070,541

(22) Filed: Mar. 2, 2005

(65) Prior Publication Data

US 2005/0194888 A1 Sep. 8, 2005

(30) Foreign Application Priority Data

Mar. 3, 2004 (KR) ..... 10-2004-0014257

(51) Int. Cl.
*H01J 1/62* (2006.01)

(52) U.S. Cl. ..... 313/495; 313/462; 313/497

(58) Field of Classification Search ..... 313/495–497, 313/461, 462, 477 R, 326
See application file for complete search history.

(56) References Cited

U.S. PATENT DOCUMENTS 5,463,273 A * 10/1995 Kato et al. ..... 313/461
5,491,376 A * 2/1996 Levine et al. ..... 313/495
5,608,286 A 3/1997 Levine et al.
5,637,958 A 6/1997 Levine

FOREIGN PATENT DOCUMENTS

| | | |
|---|---|---|
| JP | 58-188955 | 12/1983 |
| JP | 08-212924 | 8/1996 |
| JP | 11-273557 | 10/1999 |
| JP | 11-317181 | 11/1999 |
| KR | 1998-023556 | 7/1998 |
| KR | 1999-012416 | 2/1999 |

* cited by examiner

*Primary Examiner*—Ashok Patel
(74) *Attorney, Agent, or Firm*—Christie, Parker & Hale, LLP

(57) ABSTRACT

Disclosed is a flat panel display device including a first substrate; an electron emitting region formed on the first substrate; a second substrate opposing the first substrate with a predetermined gap therebetween; a vacuum assembly being formed by the first and the second substrates; and a light emitting region including a phosphor layer with a predetermined pattern and emitting light by electrons emitted from the electron emitting region, and an anode formed on one side of the phosphor layer, wherein the projections and depressions are formed on the anode, or on the second substrate.

18 Claims, 6 Drawing Sheets

FLAT PANEL DISPLAY DEVICE

CROSS REFERENCE TO RELATED APPLICATION

This application claims priority to and the benefit of Korean Patent Application No. 10-2004-0014257 filed on Mar. 3, 2004 in the Korean Intellectual Property Office, the entire content of which is incorporated herein by reference.

FIELD OF THE INVENTION

The present invention relates to a flat panel display device, and more particularly, to a flat panel display device in which the phosphor has a strong adhesive force, thereby providing improved display quality.

BACKGROUND OF THE INVENTION

A flat panel display device generally includes a cathode that emits electrons and an anode that emits light by electrons emitted from the cathode, respectively aligned on two substrates to display an image.

Based on the structure of a flat panel display device, an electron emission display, one of the flat panel display devices, aligns with a cold cathode electron emission source on the cathode substrate, and an anode on which green, blue and red color phosphor layers have been formed is impinged by an electron beam, thereby producing a color display.

The phosphor layer is produced by preparing a phosphor slurry including a photo-resist resin of photosensitive polymers and other additives such as a photo cross-linking agent and a dispersing agent, and coating the slurry on a black layer pattern of a substrate followed by drying. Thereafter, the dried substrate is mounted with a mask and is exposed using a mercury lamp at a high pressure followed by washing with pure water to produce a phosphor layer.

Various attempts have been suggested in order to improve the adhesion between the phosphor layer and the substrate. Such attempts have included the use of chemical additives such as an acrylamide, a di-acetone acrylamide copolymer, or a diazo-photosensitive agent (Korean laid-open patent publication No. 99-12416), or an acryl emulsion (Korean laid-open patent publication No. 98-23556). However, such chemical additives may remain in the resulting phosphor layer after the subsequent sintering step, and can form a char which deteriorates the quality of the resulting flat panel display devices.

Other attempts have included providing a pre-coating solution before coating the phosphor layer, or surface-treating the phosphor with a material such as $SiO_2$. However, these methods use still more chemical materials such that the foregoing problem cannot be fully overcome.

SUMMARY OF THE INVENTION

In one embodiment of the present invention, a flat panel display device is provided with good adhesion between the phosphor layer and the substrate without using chemicals.

According to an embodiment of the present invention, a flat panel display device includes a first substrate; an electron emitting region formed on the first substrate; a second substrate opposing the first substrate with a predetermined gap therebetween; and a light emitting region. The first and the second substrates together form a vacuum assembly. The light emitting region includes a phosphor layer with a predetermined pattern which emits light when electrons are emitted from the electron emitting region, and an anode formed on one side of the phosphor layer. In the flat panel display device of the present invention, the anode or the second substrate include projections and depressions.

DETAILED DESCRIPTION

Figure 1:
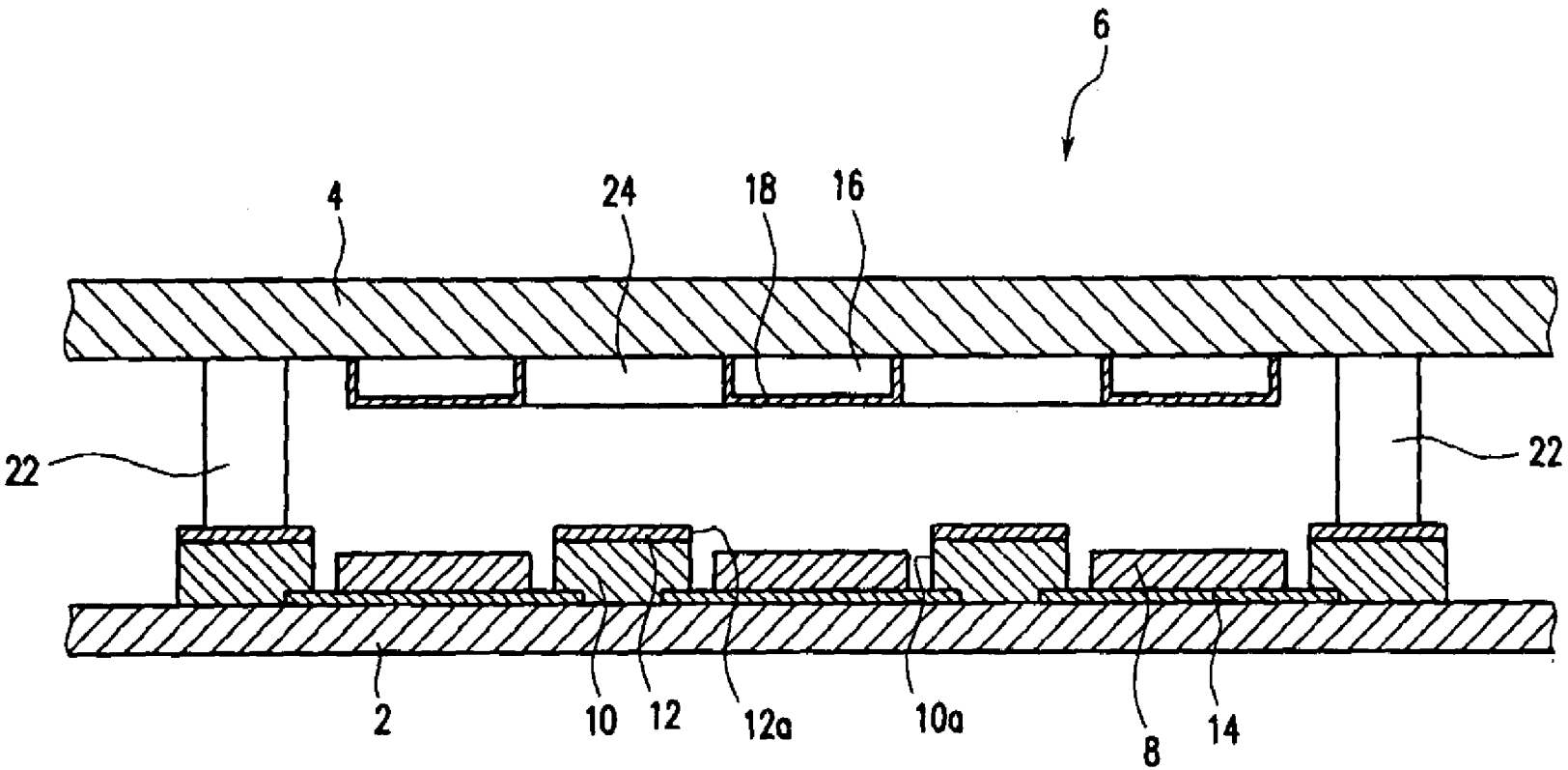
FIG. 1 is a partial cross section illustrating the flat display apparatus.

The present invention includes the formation of projections and depressions that are unevenly formed on a substrate to be formed with a phosphor layer so that such unevenness of the substrate allows for strong adhesion of the phosphor layer on the substrate. That is, the projections and depressions firmly hold the phosphor layer during coating and sintering, thereby physically improving the adhesion between the substrate and the phosphor layer. The improved adhesion may be achieved without additional chemicals.

Methods for forming projections on anodes are taught in U.S. Pat. Nos. 5,637,958 and 5,608,286. However, in those patents, it is desired to etch the substrate with a very precise, fixed prism shape in order to decrease scattering of light. However, according to the present invention, the projections and depressions can be formed with much simpler processing techniques because very precise prism shapes are not required.

The preparation of the projections and depressions will now be illustrated in more detail. The projections and depressions are formed on a substrate. The projections and depressions may be formed on a transparent glass substrate either before or after forming the anode. A transparent indium tin oxide (ITO) electrode is preferable as the anode when the projections and depressions are formed on a glass substrate, and a metal thin layer, for example an Al thin layer, is preferred as the anode when the projections and depressions are formed on the anode electrode.

The projections and depressions may be formed by a wet etching process by a chemical method, or by a dry etching process such as a RIE (reactive ion etching). The wet-etching process is performed by using an etchant including a mixture of hydrochloric acid and nitric acid at an appropriate ratio, for example 1:1, at about 50° C.

The dry etching is performed by using a gas such as HBr which is generally used in dry etching processes. Independent of whether the wet etching or the dry etching process is performed, a preferred range of surface roughness (Ra) of 0.0001 μm<Ra<0.3 μm, can be obtained when an etching process is performed for 1 to 100 seconds and preferably for less than 100 seconds. An etching process for more than 100 seconds etches the substrate too severely. In particular, this is problematic for an anode-formed glass substrate because severe etching causes the anode to be substantially completely removed from the glass substrate.

The projections and depressions can take any of several different shapes. For example, they can be formed uniformly in a saw tooth arrangement, or they can be of an irregular shape. They can be formed on all areas of the substrate or the substrate can be divided into several areas with projections and depressions of different shapes formed on each of the areas.

The surface roughness of the substrate may be controlled according to the process for forming the projections and depressions, and is preferably controlled to be in the range of 0.0001 μm to 0.3 μm and more preferably in the range of 0.01 μm to 0.1 μm. If the surface roughness of the substrate is less than 0.0001 μm, the desired effect of forming the projections and depressions is not realized. If the surface roughness of the substrate is more than 0.3 μm, the adhesion between the phosphor layer and the substrate decreases, and the etching is too severe. In particular, if the etching is performed to more than 0.3 μm on the anode-formed glass substrate, the anode may be substantially completely removed from the glass substrate.

Figure 2:
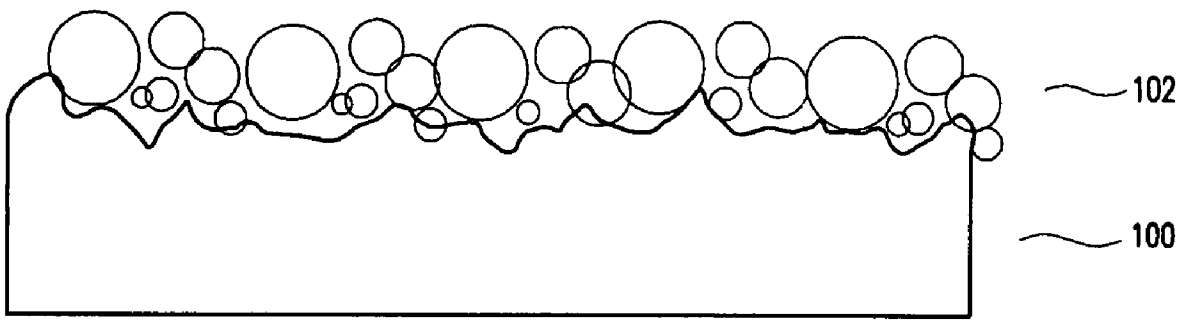
FIG. 2 is a partial cross section illustrating a phosphor layer formed on a substrate that includes the projections and depressions of one embodiment of the present invention.
Figure 3:
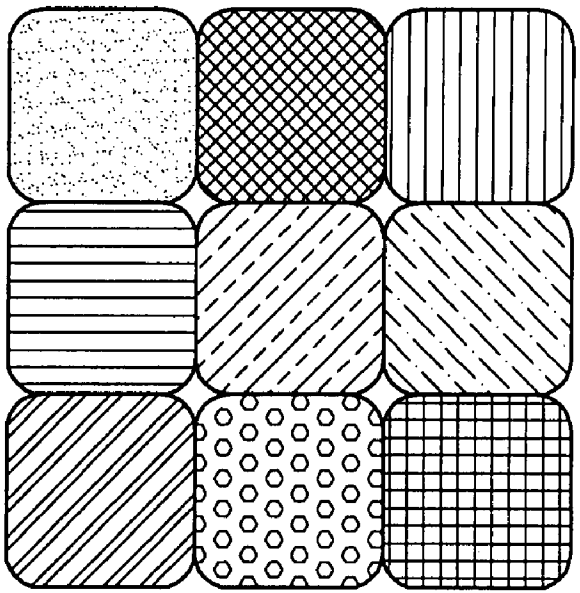
FIG. 3 is a plan view showing a substrate with different areas, each having a different pattern of projections and depressions.

Thereafter, a black layer is formed on the substrate over the projections and depressions and a phosphor slurry is coated on the black layer followed by sintering, thereby preparing a phosphor layer. As the substrate is formed with the projections and depressions, the surface of the phosphor layer exhibits a rough shape. FIG. 2 is a cross section of the phosphor layer formed by coating the phosphor 102 on the substrate 100 that includes an irregular set of projections and depressions. Alternatively, FIG. 3 is a plan view of a substrate which has been divided into several areas with projections and depressions of a different shape on each of the areas.

The flat panel display device of the present invention includes a first substrate; an electron emitting region formed on the first substrate; a second substrate opposing the first substrate with a predetermined gap therebetween; and a light emitting region. The first and the second substrates form a vacuum assembly. The light emitting region includes a phosphor layer with a predetermined pattern and which emits light by electrons emitted from the electron emitting region, and an anode formed on one side of the phosphor layer. According to this embodiment, the projections and depressions are formed on the anode or the second substrate.

The phosphor layer includes, for example, a green phosphor, a blue phosphor, and a red phosphor. Exemplary phosphors include a green phosphor such as ZnS:Cu,Al, a blue phosphor such as ZnS:Ag,Cl, and a red phosphor such as $Y_2O_3$:Eu or $SrTiO_3$:Pr,Al.

The flat panel display device of the present invention is described with reference to the cross section of the electron emission display device shown in FIG. 1. However, the flat panel display device of the present invention is not limited by the electron emission display device shown in FIG. 1 as is well understood to one skilled in the related art.

With reference to the drawings, the electron emission display device includes a first substrate 2 (or a cathode substrate) of predetermined dimensions, and a second substrate 4 (or an anode substrate) of predetermined dimensions. The second substrate 4 is provided substantially in parallel to the first substrate 2 with a predetermined gap therebetween. When interconnected, the first and the second substrates 2 and 4 form a vacuum assembly 6 that defines the electron emission display device.

In the vacuum assembly, the electron emitting region is provided on the first substrate 2, and the light emitting region being capable of realizing predetermined images by the electrons emitted from the electron emitting region, is provided on the second substrate 4. An example of the light emitting region follows:

The electron emitting region includes a cathode 8 formed on the first substrate 2, an insulating layer 10 formed on the cathode 8, a gate electrode 12 formed on the insulating layer 10, and the electron emitting source 14 formed on the cathode 8 provided with holes 10*a* and 12*a* formed penetrating the insulating layer 10 and the gate electrode 12.

The cathode electrode 8 is formed on the first substrate 2 in a predetermined pattern, e.g., a stripe pattern, at predetermined intervals, and the insulation layer 10 is deposited at a predetermined thickness over an entire surface of the first substrate 2 and covering the cathode electrode 8.

Moreover, a plurality of gate electrodes 12, each with a gate electrode hole 12*a* linked to an insulator hole 10*a* are formed on the insulating layer 10 at predetermined intervals and perpendicularly intersecting the cathode electrode 8 in a striped pattern.

The electron emission source 14 is formed on the cathode electrode 8 provided within the holes 10*a*, 12*a*. The electron emission source is formed using one or more carbon-based material selected from carbon nano-tubes, C60 (Fullerene), diamond, DLC (diamond like carbon) or graphite with carbon nano-tubes being preferred.

In the present invention, the type or the shape of the material or shape of the electron emission source, of course, is not limited. For example, the electron emission source may be formed using molybdenum in a cone shape. That is, in the present invention there is no restriction in the material and shape of the electron emission source 14.

The electron emitting region emits electrons from the electron emission source 14 according to a distribution of an electric field formed between the cathode electrode 8 and the gate electrode 12 by applying a voltage differential between the cathode electrode 8 and the gate electrode 12 from outside of the vacuum assembly 6. However, the structure of the electron emitting region is not so limited. Alternatively, the electron emitting region may include a gate electrode formed on a first substrate, a cathode substrate, an insulator layer formed on the gate electrode, a cathode electrode formed on the insulator layer, and an electron emission source electrically connected to the cathode.

The light emitting region includes an anode electrode 16 formed on one surface of the second substrate 4 (the surface to be opposite to the first substrate) and red (R), green (G) and blue (B) color phosphor regions 18 are formed on one surface of the anode electrode 16. A black layer 24 is formed between the color phosphor regions 18.

The anode electrode 16 may be made of a transparent material such as indium tin oxide (ITO), or may be made of a metal thin layer such as aluminum. Moreover, the anode electrode may be formed on the second substrate in multiple forms such as with a predetermined gap, e.g. a stripe pattern, or may be formed on the second substrate as a single form. Alternatively, the anode electrode may be formed on the second substrate in multiple different portions. The phosphor layer 18 and the black layer 24 may be formed on the anode electrode 16 by processes such as an electrophoresis process, a screen printing process, or a spin coating process.

The following examples illustrate the present invention in further detail, but it is understood that the present invention is not limited by these examples.

EXAMPLE 1

An ITO anode electrode of a thickness of 3000 Å was formed on a transparent glass substrate. The anode-formed glass substrate was etched for 30 seconds by using an ITO etchant at 50° C. to form irregular projections and depressions on the surface of the anode electrode. Thereafter, a ZnS:Ag,Cl green phosphor slurry was coated on the resulting anode electrode and sintered for 10 minutes at 450° C. to thereby produce a light emitting region.

COMPARATIVE EXAMPLE 1

Figure 4:
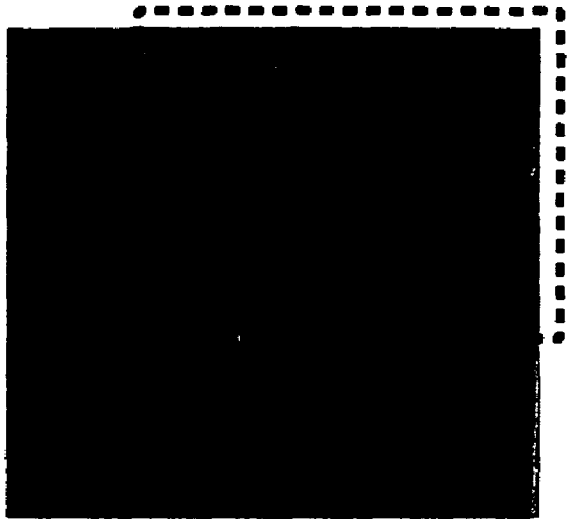
FIG. 4 is a photograph showing the surface of the phosphor layer according to Example 1 of the present invention.
Figure 5:
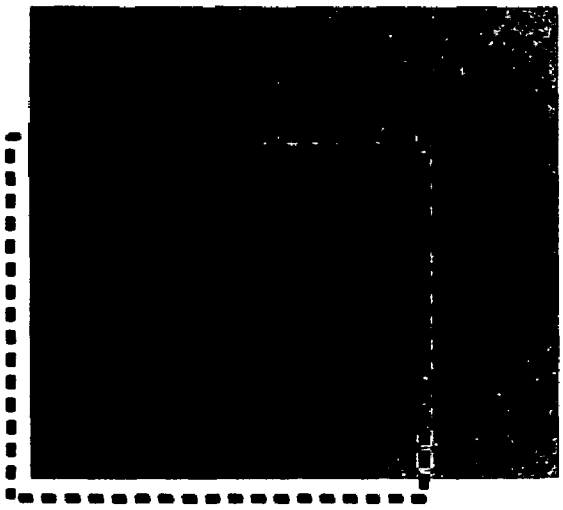
FIG. 5 is a photograph showing the surface of the phosphor layer according to Comparative Example 1.

A light-emitting region was produced by the same procedure as in Example 1, except that the etching process was not performed. In order to measure adhesion of the light emitting region according to Example 1 and Comparative Example 1, adhesive tape was bonded on the sintered phosphor layer screen and pressure was applied. The tape was removed and the phosphor layer remaining on the substrate was observed. FIG. 4 shows a surface photograph of the phosphor layer according to Example 1, and FIG. 5 shows a surface photograph of the phosphor layer according to Comparative Example 1, both after the adhesive tape had been removed. As shown in FIG. 4, for Example 1, the phosphor remained on the anode electrode after removal of the adhesive tape, but as shown in FIG. 5, for Comparative Example 1, the phosphor scarcely remained as the anode electrode surface was revealed.

Figure 6:
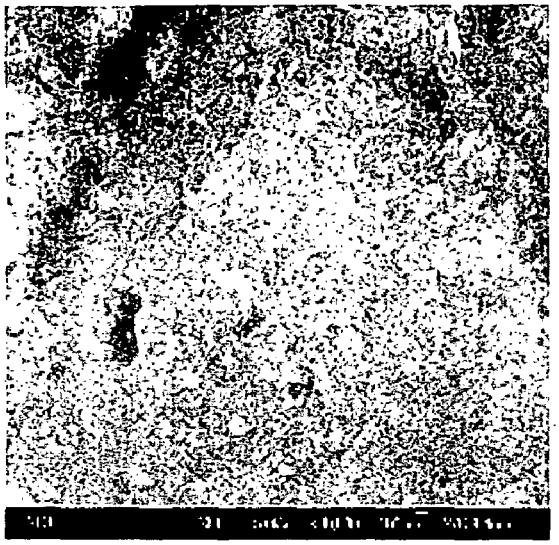
FIG. 6 is a SEM photograph showing the surface of the anode electrode according to Example 1 of the present invention.
Figure 7:
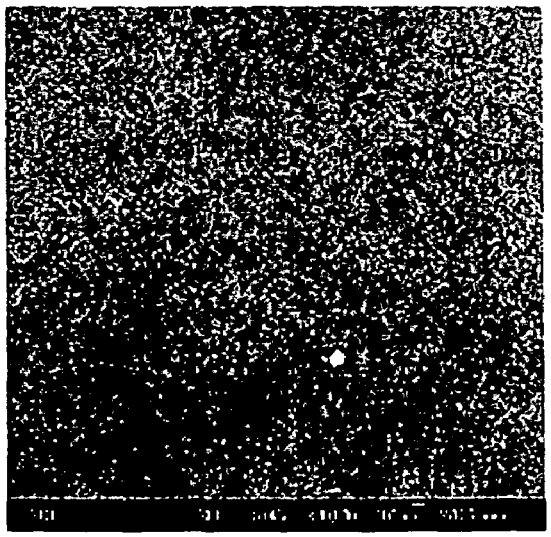
FIG. 7 is a SEM photograph showing the surface of the anode electrode according to Comparative Example 1.

FIG. 6 shows a SEM photograph of the anode electrode surface according to Example 1, and FIG. 7 shows a SEM photograph of the anode electrode surface according to Comparative Example 1. As shown in FIG. 6, the irregular projections and depressions were created on the surface of the anode electrode according to Example 1 by the etching process, but as shown in FIG. 7, for Comparative Example 1 the projections and depressions scarcely existed on the surface of the anode electrode.

EXAMPLE 2 to 11

A light emitting region was produced by the same procedure as in Example 1, except that the etching process was performed for the time periods shown in Table 1.

COMPARATIVE EXAMPLE 2

A light emitting region was produced by the same procedure as in Example 1, except that the etching process was not performed.

COMPARATIVE EXAMPLES 3 to 6

A light emitting region was produced by the same procedure as in Example 1, except that the etching process was performed for the time periods shown in Table 1.

In order to measure adhesion of the phosphor layers according to Examples 1 to 11 and Comparative Examples 2 to 6, the weights before and after bonding the adhesive tape were measured. The weight of the phosphor layer remaining on the substrate after removal of the tape was expressed as a % ratio of the weight of the phosphor layer on the substrate before bonding the tape. The results are presented in Table 1.

TABLE 1

| | Time (sec) | Weight (%) | Surface roughness (Ra) (μm) |
|---|---|---|---|
| Comparative Example 2 | 0 | 22 | 0.0001 |
| Example 2 | 1 | 22 | 0.019 |
| Example 3 | 5 | 30 | 0.024 |
| Example 4 | 10 | 56 | 0.028 |
| Example 5 | 15 | 72 | 0.030 |
| Example 6 | 20 | 81 | 0.032 |
| Example 1 | 30 | 94 | 0.041 |
| Example 7 | 40 | 93 | 0.052 |
| Example 8 | 50 | 91 | 0.063 |
| Example 9 | 60 | 80 | 0.72 |
| Example 10 | 70 | 80 | 0.131 |
| Example 11 | 80 | 77 | 0.225 |
| Comparative Example 3 | 100 | 70 | — |
| Comparative Example 4 | 120 | 66 | — |
| Comparative Example 5 | 150 | 62 | — |
| Comparative Example 6 | 200 | 62 | — |

—denotes that ITO was entirely etched.

Figure 8:
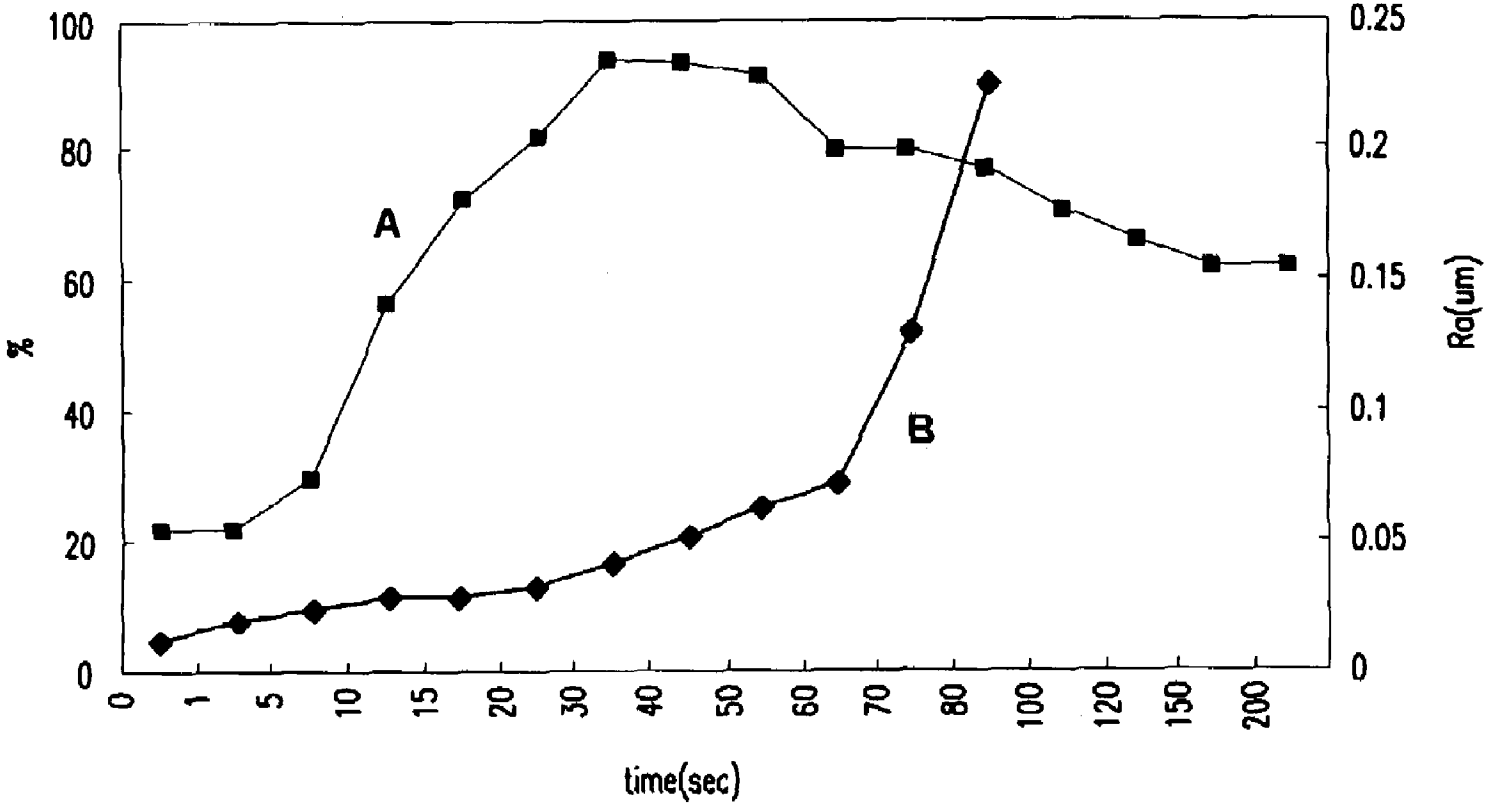
FIG. 8 is a graph showing variation of the surface roughness of the phosphor layer as a function of etching time according to Example 1 of the present invention and Comparative Example 1.

FIG. 8 is a graph showing the variation of the surface roughness of the phosphor layer as a function of etching time according to Example 1 of the present invention and Comparative Example 1. In FIG. 8, reference numeral A indicates wt % in Table 1, and the reference numeral B indicates surface roughness in Table 1.

As shown in Table 1, for Comparative Example 2 in which there was no etching, the surface roughness was very low at 0.0001 μm. For Comparative Example 3 to 5 in which the etching times were over 100 seconds, the ITO was completely removed by the etching process. Whereas, in the case of Examples 1 to 11 with the etching times of 1 to 80 seconds, appropriate surface roughness was achieved.

As described above, the present invention can provide a flat panel display device in which the adhesion between the phosphor layer and the substrate is improved by a process of forming projections and depressions on the surface of the substrate without using chemical materials.

What is claimed is:

1. A flat panel display device comprising:

a first substrate;

an electron emitting region formed on the first substrate;

a second substrate opposing the first substrate with a gap therebetween; the first and the second substrates forming a vacuum assembly; and a light emitting region comprising: an anode; and a phosphor layer adjacent the anode and defining a phosphor layer pattern; wherein at least one of the anode and the second substrate defines a pattern of projections and depressions adjacent the phosphor layers, wherein the pattern of projections and depressions impart a surface roughness (Ra) ranging from about 0.0001 μm to about 0.3 μm.

2. The flat panel display device according to claim 1, wherein the anode defines the pattern of projections and depressions.

3. The flat panel display device according to claim 2, wherein the anode has a surface roughness (Ra) from 0.01 μm to 0.1 μm.

4. The flat panel display device according to claim 1, wherein the second substrate defines the pattern of projections and depressions.

5. The flat panel display device according to claim 4, wherein the second substrate has a surface roughness (Ra) from 0.01 μm to 0.1 μm.

6. The flat panel display device according to claim 1, wherein the projections and depressions are formed by wet etching or dry etching.

7. The flat panel display device according to claim 1, wherein the anode is a transparent electrode.

8. The flat panel display device according to claim 7, wherein the anode is an indium tin oxide (ITO) electrode.

9. A flat panel display device comprising:

a first substrate;

an electron emitting region formed on the first substrate;

a second substrate opposing the first substrate with a gap therebetween;

wherein the second substrate defines a pattern of projections and depressions and has a surface roughness ranging from about 0.0001 μm to about 0.3 μm, and the first substrate and the second substrate form a vacuum assembly; and a light emitting region comprising an anode and a phosphor layer with a phosphor layer pattern, wherein the phosphor layer is adjacent the projections and depressions of the second substrate.

10. The flat panel display device according to claim 9, wherein the second substrate has a surface roughness (Ra) of 0.01 μ<Ra<0.1 μm.

11. The flat panel display device according to claim 9, wherein the projections and depressions are formed by wet etching or dry etching.

12. The flat panel display device according to claim 9, wherein the anode electrode is made of a thin layer of a metal.

13. The flat panel display device according to claim 12, wherein the metal is aluminum.

14. A flat panel display device comprising:

a first substrate;

an electron emitting region formed on the first substrate;

a second substrate opposing the first substrate with a gap therebetween;

the first substrate and the second substrate forming a vacuum assembly; and a light emitting region comprising: an anode defining a pattern of projections and depressions and having a surface roughness ranging from about 0.0001 μm to about 0.3 μm: and a phosphor layer with a phosphor layer pattern; wherein the phosphor layer is adjacent the projections and depressions of the anode.

15. The flat panel display device according to claim 14, wherein the anode has a surface roughness (Ra) of 0.01 μm<Ra<0.1 μm.

16. The flat panel display device according to claim 14, wherein the projections and depressions are formed by wet etching or dry etching.

17. The flat panel display device according to claim 14, wherein the anode is a transparent electrode.

18. The flat panel display device according to claim 14, wherein the anode is an indium tin oxide (ITO) electrode.

* * * * *

UNITED STATES PATENT AND TRADEMARK OFFICE

CERTIFICATE OF CORRECTION

PATENT NO. : 7,378,787 B2
APPLICATION NO. : 11/070541
DATED : May 27, 2008
INVENTOR(S) : Soo Joung Lee It is certified that error appears in the above-identified patent and that said Letters Patent is hereby corrected as shown below:

| | |
|---|---|
| Column 6, lines 52-53, Claim 1 | Delete "layers",<br>Insert --layer-- |
| Column 7, line 23, Claim 10 | Delete "μ<Ra<0.1 μm",<br>Insert --μm<Ra<0.1 μm-- |

Signed and Sealed this

Seventeenth Day of February, 2009

JOHN DOLL
*Acting Director of the United States Patent and Trademark Office*